US007234394B1

(12) United States Patent
Bell, Jr. et al.

(10) Patent No.: US 7,234,394 B1
(45) Date of Patent: Jun. 26, 2007

(54) CHUTE CORNER WITH SPRING LOADED CHUTE LINER

(75) Inventors: Lemuel J. Bell, Jr., Gurnee, IL (US); Ronald W. Gurak, Oakwood Hills, IL (US)

(73) Assignee: Illinois Tool Works Inc.

( * ) Notice: Subject to any disclaimer, the term of this patent is extended or adjusted under 35 U.S.C. 154(b) by 0 days.

(21) Appl. No.: 11/278,499

(22) Filed: Apr. 3, 2006

(51) Int. Cl.
*B65B 13/06* (2006.01)

(52) U.S. Cl. ..... 100/26; 242/615.3

(58) Field of Classification Search ..... 100/25, 100/26, 33 PB; 53/589; 226/196.1; 242/615.3, 242/548, 566
See application file for complete search history.

(56) References Cited

U.S. PATENT DOCUMENTS 3,572,237 A * 3/1971 Kurihara ..... 100/26
4,711,071 A * 12/1987 Kagi ..... 53/589
5,613,432 A * 3/1997 Hoshino ..... 100/26
6,499,525 B1 * 12/2002 Lai ..... 156/580

* cited by examiner

*Primary Examiner*—Jimmy Nguyen
(74) *Attorney, Agent, or Firm*—Mark W. Croll; Donald J. Breh; Levenfeld Pearlstein, LLC

(57) ABSTRACT

A chute corner assembly with a spring loaded chute liner for use in a strapping machine comprises a recess for receiving an end of an adjacent chute liner, a chute liner spring plate for engaging the end of the chute liner, a spring for biasing the chute liner away from the chute corner assembly and towards an opposite chute corner. The chute corner assembly of the present invention is used connection with a chute liner to eliminate the gap between the corner assembly and the chute liner, and to simultaneously dynamically eliminate any gap between the chute liner and the opposite chute corner.

6 Claims, 3 Drawing Sheets

CHUTE CORNER WITH SPRING LOADED CHUTE LINER

BACKGROUND OF THE INVENTION

The present invention is directed to an improved chute corner design for a strapping machine (or "strapper"). More particularly, the present invention is directed to a chute corner assembly with a spring loaded chute liner.

Strapping machines are in widespread use for securing straps around loads. One type of known strapper includes a strapping head and drive mechanism mounted within a frame. Mounted to the frame is a chute through which strapping material is fed. Means generally are provided in the chute for guiding and retaining the strap in the chute so that the strap cannot fall or be pulled inwardly against the load until after the loop has been formed. Such means usually include a strap release system that permits the strap to be released from the chute upon tensioning.

Typically, the chute is larger than the load to be strapped so as to accommodate various load sizes and, thus, such strap guiding and retaining means function to initially maintain the strap in the largest possible loop configuration and, of course, function to permit the strap to be fed around the load without impinging upon or snagging upon the load. Moreover, the chute typically is constructed in a shape and size suitable to surround the load to be strapped, and generally is constructed in a quadrilateral shape, such as a square or a rectangle, with four corners, since most loads to be strapped share the same shape.

Prior art chute designs generally employ modular chute components, which are assembled to form the desired chute size and shape. For square and rectangular chutes, the chutes generally are comprised of horizontal and vertical chute sections, which often are supported by lightweight but sturdy aluminum support beams, and connected by four corner assemblies, typically constructed of a glass filled nylon material. The chute typically is enclosed by a strap retaining and release means of the type well known in the prior art.

Additionally, to facilitate the travel of the strap through the chute, many prior art chute designs also include chute liners mounted on the chute sections and within the chute. Such chute liners typically are slidably mounted or clipped on to the support beams, and are constructed to provide a smooth, flat surfaced along which the strap traverses during its travel around the chute. Preferably, the chute liner has a low coefficient of kinetic friction to facilitate movement of the strap through the chute. Additionally, such chute liners are machined to a precise length so as to minimize any gaps between the ends of the chute liners and the adjacent corner assemblies. For the reasons discussed below, the existence of such gaps adversely affects the travel of the strap through the chute.

In a typical stationary bottom-seal strapper, the chute is mounted at about a work surface, and the strapping head is mounted to a horizontal portion of the chute, below the work surface. The drive mechanism is also mounted below the work surface, near to the strapping head. The drive mechanism "pulls" or feeds strap material from a source, such as dispenser, into the machine. The drive mechanism urges or feeds the strap through the strapping head, into and around the chute, until the strap material returns to the strapping head to form a loop. After the strap loop has been formed, tension is applied to the strap to constrict the strap loop about the article and the overlapping strap ends are secured by conventional means.

Traditional side-seal strappers employ a similar configuration, except that the strapping head is mounted to a vertical portion of the chute, with the drive mechanism positioned in lateral proximity to the strapping head for the strap material. However, from an operational perspective, side-seal strappers and bottom-seal strappers are more or less equivalent.

Many such machines are employed in processes that maximize the use of fully automated operation. To this end, machines are configured for automated in-feed and out-feed, such that a load to be strapped is automatically fed into the machine by an in-feed conveyor, the strapping process is carried out, and the strapped load is automatically fed out of the machine by an out-feed conveyor. As such, an improper strapping event, such as a strap short feed, wherein the strap does not create a full loop around the load, can create a detrimental "ripple effect" along the entire automated strapping process by forcing the shutdown of an entire strapping line. Thus, it is critical to ensure that the occurrence of improper strapping events is minimized.

One of the major causes of improper strapping events is a strap short feed. A strap short feed occurs, as discussed above, when the strap does not create a full loop around the load. Strap short feeds are an inherent problem in prior art modular chute designs in which multiple chute sections and corners are assembled to form a desired chute size and shape. The interface between each chute section and each corner assembly creates potential areas where the strap may get impinged or snagged.

Specifically, frequent causes of strap short feeds in such prior chute designs are inherent gaps between the chute liners and the corner assemblies. Even a small gap can catch the leading edge of the strap material as it traverses through the chute causing the strap to hang or snag. The prior art has attempted to address the problem by altering the design of the chute liner.

For example, some chute liners are machined with a bevel on the leading edge of the chute liner. The bevel is intended to minimize the effect of any gap between the end of the chute liner and the adjacent face of the corner assembly. Similarly, the prior art has resorted to precise measurement and machining of the end of the chute liner so as to minimize the size of the gap.

However, such precise machining of the chute liner adds cost and time to the strapper manufacturing process. Moreover, since the chute liner often is comprised of a different material than the chute sections and corner assemblies, and since the different materials exhibit different thermal expansion and contraction rates during use, the precise machining of the chute liner often is of limited effect. A negligible gap between the chute liner and the corner assembly present during the manufacture of the strapper may expand into a troublesome gap under various operating conditions.

Accordingly, there is a need for an improved chute corner assembly designed to minimize the undesirable gap between the chute corner assembly and the chute liner. Desirably, such a chute corner assembly includes a recess for receiving the end of an adjacent chute liner. More desirably, such a corner assembly includes a chute liner spring plate for engaging the end of the chute liner. Most desirably, such a corner assembly includes a spring mechanism to bias the chute assembly away from the corner assembly and toward the opposite corner assembly in order to dynamically minimize any gap between the chute liner and the opposite corner assembly by allowing for spring-biased slidable movement of the chute liner between opposite corner assemblies during thermal expansion and contraction of the chute components.

BRIEF SUMMARY OF THE INVENTION

A chute corner assembly with a spring loaded chute liner comprises a recess for receiving an end of an adjacent chute liner, a chute liner spring plate for engaging the end of the chute liner, a spring for biasing the chute liner away from the chute corner assembly and towards an opposite chute corner, and a means to retain and align the spring. The chute corner assembly of the present invention is used connection with a chute liner to eliminate the gap between the corner assembly and the chute liner, on the one hand, and to simultaneously dynamically minimize any gap between the chute liner and an opposite chute corner, on the other hand.

The chute corner assembly includes a recess into which a proximate end of the chute liner is inserted. The proximate end of the chute liner includes a chute liner spring plate having a means to engage a spring. Within the recess, the spring engagement means engages a spring removably mounted to the body of the corner assembly. When compressed in a direction towards the body of the corner assembly, the spring exerts a resistive force against the chute liner spring plate and, thus, against the proximate end of the chute liner, and biases the chute liner away from the corner assembly and towards an opposite corner assembly. Since the chute liner is slidably mounted between opposite corner assemblies along a support beam, exerting a biasing force against the chute liner causes the chute liner to traverse along the support beam.

Allowing the proximate end of the chute liner to enter the body of the corner assembly eliminates the potential gap created in prior art devices when the chute liner abutted the outside wall of the corner assembly and creates a smooth path of travel for the strap. Moreover, providing a resistive spring force against the proximate end of the chute liner biases the distal end of the chute liner against the outside wall of the opposite corner assembly, and dynamically eliminates any gap at that interface which may be created during thermal expansion and contraction. Thus, the need for precision machining of the ends of chute liner is eliminated, thereby reducing costs and manufacturing time.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

While the present invention is susceptible of embodiment in various forms, there is shown in the figures and will hereinafter be described a presently preferred embodiment with the understanding that the present disclosure is to be considered an exemplification of the invention and is not intended to limit the invention to the specific embodiment illustrated. It should be further understood that the title of this section of this specification, namely, "Detailed Description Of The Invention," relates to a requirement of the United States Patent Office, and does not imply, nor should be inferred to limit the subject matter disclosed herein.

Figure 1:
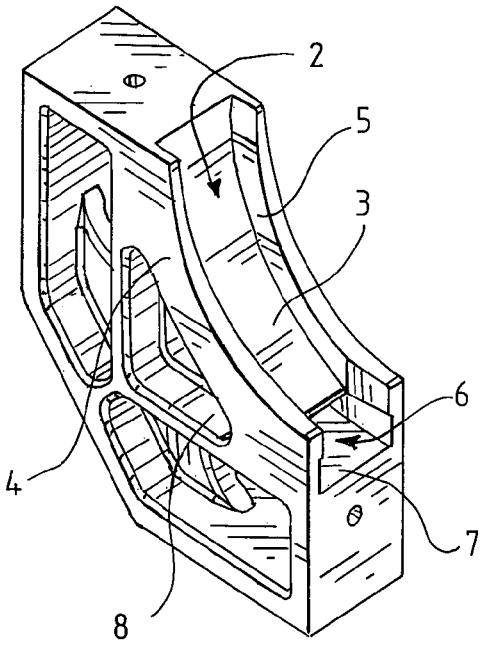
FIG. 1 is a perspective view of the chute corner assembly embodying the principles of the present invention.
Figure 2:
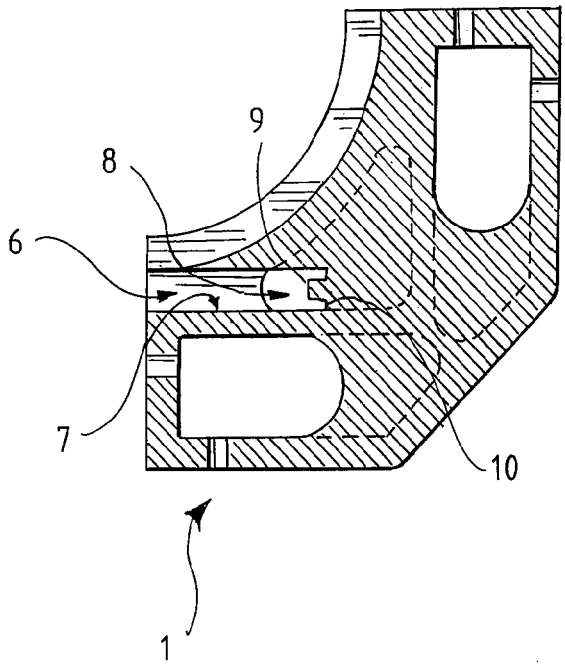
FIG. 2 is a cross-sectional side view of the chute corner assembly embodying the principles of the present invention.

As shown in FIGS. 1 and 2, the chute corner assembly 1 of the present invention is a generally L-shaped device molded in the preferred embodiment of thirteen percent glass filled nylon. Integrated within chute corner assembly 1 is a chute channel 2 through which strap material travels as it traverses through the chute. Chute channel 2 is defined by a sloped base 3, a first side wall 4, and a second side wall 5.

The chute corner assembly 1 further comprises a chute liner recess 6 integrated within the body of the assembly. Chute liner recess 6 is an opening that leads into a hollow cavity 8 of chute corner assembly 1, and is defined by sloped base 3 as its upper surface, first side wall 4 and second side wall 5 as its side surfaces, and recess base 7 as its bottom surface. Chute liner recess 6 is of appropriate geometry and dimensions to accept an end of a chute liner and to permit the end of the chute liner to travel through the recess, beneath sloped base 3, and into the hollow cavity 8 of chute corner assembly 1. In the preferred embodiment, chute liner recess 6 generally is rectangular in shape. As further shown in FIG. 2, hollow cavity 8 includes a spring retention post 9 integrated into a spring retention wall 10 that defines the rear surface of hollow cavity 8. Spring retention post 9 is generally cylindrical in shape and is designed to matingly and removably accept a spring mounted about it, as further discussed below.

Figure 3:
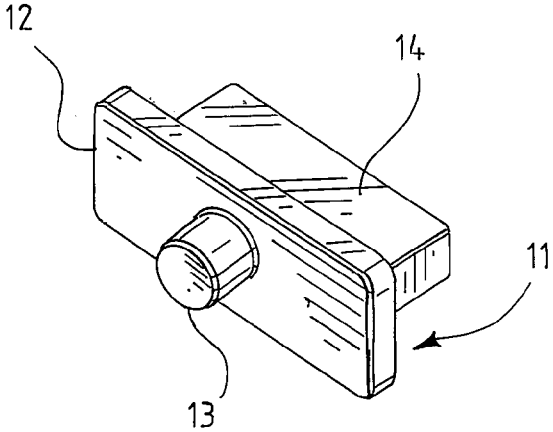
FIG. 3 is a perspective view of the chute liner spring plate embodying the principles of the present invention.

Chute liner spring plate 11, as shown in FIG. 3, includes a generally rectangular shaped base 12, with an integrated spring retention post 13 on one side. Spring retention post 13 is generally cylindrical in shape and is designed to matingly and removably accept a spring mounted about it, as further discussed below. Integrated on the other side of base 12 is a chute liner engagement tab 14. Chute liner engagement tab 14 also is generally rectangularly shaped as is of smaller dimensions than base 12. Chute liner engagement tab 14 is designed to matingly and removably interact with an end of a chute liner such that chute liner engagement tab 14 is engaged by the end of the chute liner, thus forming a cap on the end of the chute liner and permitting the chute liner to engage a spring via spring retention post 13.

Figure 4:
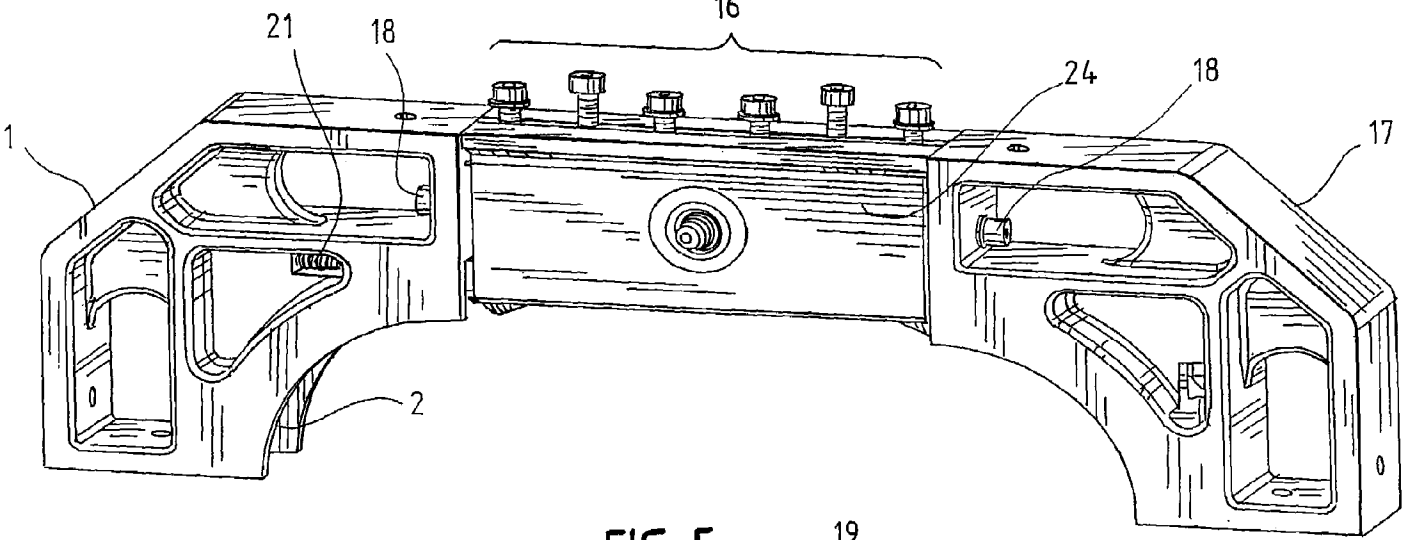
FIG. 4 is a perspective view of the chute corner assembly embodying the principles of the present invention shown in relation to an adjacent chute section and an opposite corner assembly.
Figure 6:
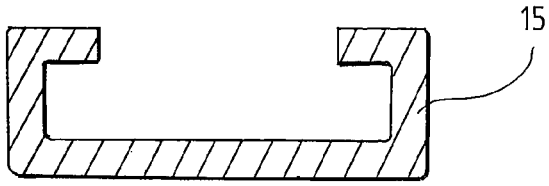
FIG. 6 is a cross-sectional end view of a chute liner of the type utilized in the present invention.
Figure 7:
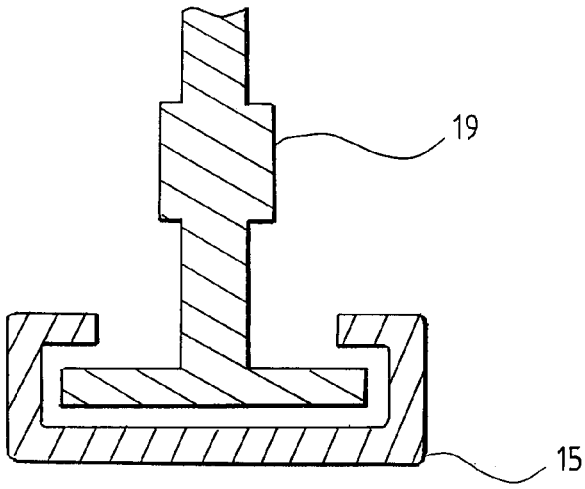
FIG. 7 is a fragmented cross-sectional end view of a chute liner slidably mounted on a chute support beam as utilized in the present invention.

As shown in FIGS. 6 and 7, the chute liner 15 in the preferred embodiment of the present invention is of the type well known in the prior art. It is designed with a generally C-shaped profile that slidably mounts along a generally I-beam shaped frame support beam 19. Support beam 19 in the preferred embodiment is constructed of aluminum and may be surrounded by an external cover 24 (FIG. 4). The design and interaction of the chute liner 15, support beam 19 and cover 24 are well known in the prior art.

Figure 5:
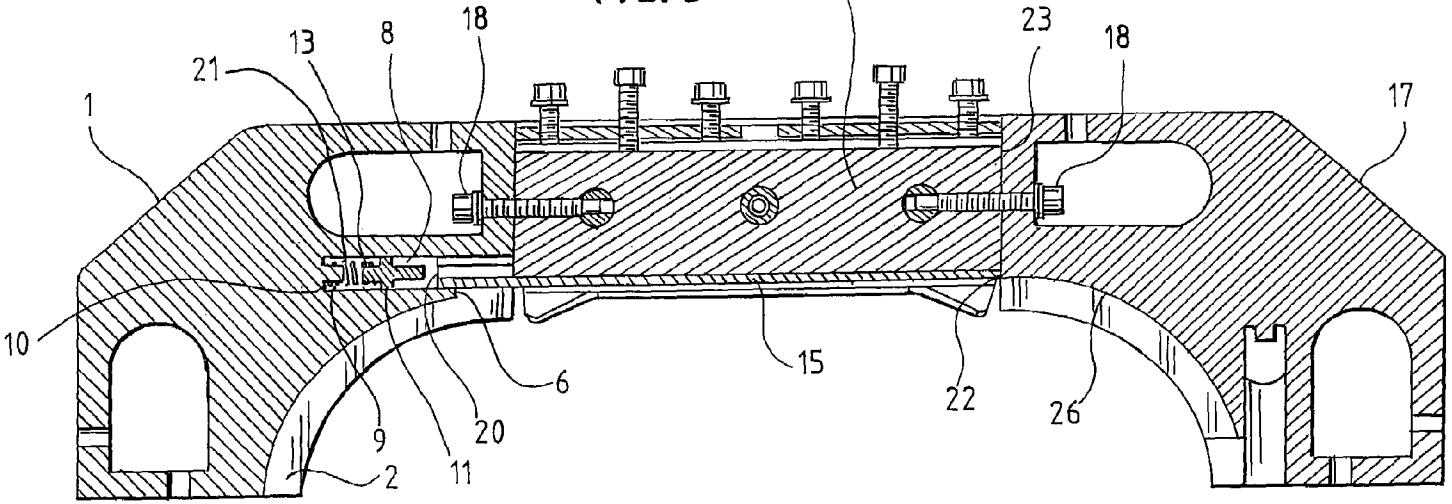
FIG. 5 is a cross-sectional side view of the chute corner assembly embodying the principles of the present invention shown in relation to an adjacent chute section and an opposite corner assembly.

FIGS. 4 and 5 show the chute corner assembly of the present invention as an assembled part of one side of a strapper frame. Chute corner assembly 1 is mounted to a proximate end of a chute section 16. A second chute corner assembly 17 is mounted to a distal end of chute section 16. Chute corner assembly 1 and second chute corner assembly 17 in the preferred embodiment are removably mounted to chute section 16 using bolts 18.

Chute section 16 is comprised of support beam 19 on which chute liner 15 is slidably mounted such that chute liner 15 may traverse longitudinally along the length of support beam 19.

The proximate end 20 of chute liner 15 extends through chute liner recess 6 into hollow cavity 8 of chute liner assembly 1. Chute liner spring plate 11 is disposed adjacent to a proximate end 20 of chute liner 15 with chute liner engagement tab 14 matingly engaging proximate end 20 of chute liner 15. Spring retention post 13 of chute liner spring plate 11 is matingly and removably engaged by a spring 21 which itself is matingly and removably engaged by spring retention post 9 in spring retention wall 10 in hollow cavity 8 of chute corner assembly 1.

Chute liner 15 is constructed of sufficient length such that the distal end 22 of chute liner 15 is abutted against an outer wall 23 of second chute corner assembly 17 while spring 21 is in a partially compressed state. In this state, spring 21 exerts a constant biasing force against chute liner 15, and causes chute liner 15 to traverse longitudinally along support beam 19 to maintain the distal end 22 of chute liner 15 abutted against outer wall 23 of second chute corner assembly 17. The length of chute liner 15 and support beam 19 will vary depending on the preferred size of the strapper frame. It will be understood, however, that the design of the chute corner assembly of the present invention may be used in conjunction with a wide range of support beam and chute liner lengths.

Figure 8:
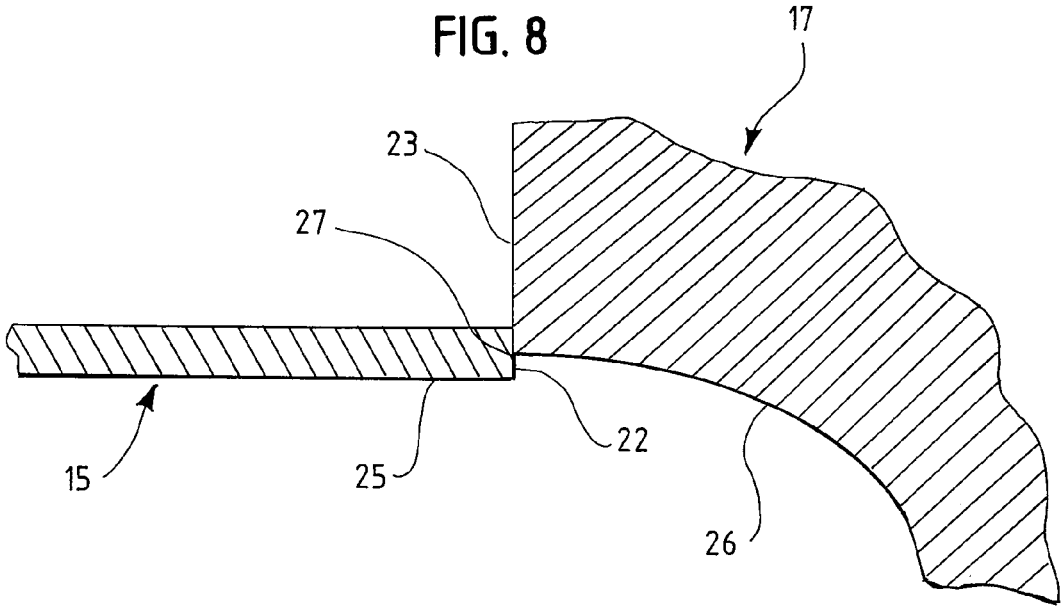
FIG. 8 is an enlarged partial cross-sectional side view of the interface between a chute liner and an opposite chute corner assembly.

Additionally, as shown in FIG. 5 and more clearly shown in FIG. 8, in the preferred embodiment of the present invention, second chute corner assembly 17 is designed such that when chute liner 15 abuts outer wall 23 of second chute corner assembly 17, the strap surface 25 of chute liner 15 is not directly aligned with the sloped base 26 of second chute corner assembly 17. This non-alignment prevents a strap from catching on the corner 27 of outer wall 23 of second chute corner assembly 17, as further discussed below.

In operation, a strap travels through chute channel 2 of chute corner assembly 1 in a generally clockwise direction (with respect to chute corner assembly 1, chute section 16, and second chute corner assembly 17 as assembled and shown in FIGS. 4 and 5). The strap traverses across the interface of chute liner 15 and chute corner assembly 1 without catching on the proximate end 20 of chute liner 15 since the proximate end 20 of chute liner 15 is disposed within the hollow cavity 8 of chute corner assembly 1 and out of the path of travel of the strap.

Similarly, the strap traverses along the strap surface 25 of chute liner 15 and across the interface of chute liner 15 and second chute corner assembly 17 without catching on the outer wall 23 of second chute corner assembly 17 since the distal end 22 of chute liner 15 is abutted against outer wall 23 of second chute corner assembly 17, and since outer wall 23 and corner 27 of second chute corner assembly 17 are located out of the path of travel of the strap.

Moreover, since support beam 19, chute liner 15, chute corner assembly 1 and second chute corner assembly 17 are not comprised of the same material, the components will exhibit unique thermal expansion and contraction characteristics under changing operating conditions, such as increased and decreased ambient heating and cooling conditions. In such an event, the constant biasing force exerted by spring 21 against chute liner 15 dynamically eliminates any gap that may form at the interface of chute liner 15 and the outer wall 23 of second chute corner assembly 17 during thermal expansion and contraction.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

What is claimed is:

1. A strapping machine frame assembly comprising:

a first chute corner assembly;

a second chute corner assembly;

a support beam disposed between the first chute corner assembly and the second chute corner assembly;

a chute liner;

a chute liner spring plate; and a spring;

wherein the chute liner is slidably mounted on the support beam, the chute liner spring plate is positioned within a hollow cavity formed within the first chute corner assembly, the chute liner spring plate engaging a proximate end of the chute liner, the proximate end of the chute liner is disposed within the hollow cavity formed within the first chute corner assembly, the spring is disposed between the chute liner spring plate and a rear wall of the hollow cavity, and a distal end of the chute liner is disposed in an abutting relationship with an outer surface of the second chute corner assembly; and wherein the spring exerts a biasing force against the proximate end of the chute liner causing the distal end of the chute liner to maintain the abutting relationship with the outer surface of the second chute corner assembly.

2. The strapping machine frame assembly in accordance with claim 1 wherein the distal end of the chute liner is unaligned with the outer surface of the second chute corner assembly.

3. The strapping machine frame assembly in accordance with claim 1 wherein the rear wall of the hollow cavity further comprises a spring retention post.

4. The strapping machine frame assembly in accordance with claim 3 wherein the chute liner spring plate further comprises a spring retention post.

5. The strapping machine frame assembly in accordance with claim 4 wherein the spring is coaxially mounted between the spring retention post of the rear wall and the spring retention post of the chute liner spring plate.

6. A chute corner assembly for use in a strapping machine frame assembly comprising:

a body;

a chute channel integrated within the body;

a chute liner recess integrated within the body;

a hollow cavity formed within the body;

a spring retention post disposed within the hollow cavity formed within the body;

a spring mounted on the spring retention post;

a chute liner spring plate mounted on the spring;

wherein the chute liner recess is designed to accept an end of a chute liner and to allow the end of the chute liner to enter the hollow cavity formed within the body to prevent a formation of a gap between the chute channel and the end of the chute liner.

* * * * *